United States Patent [19]

Blackwood

[11] 4,177,001

[45] Dec. 4, 1979

[54] FORKLIFT ATTACHMENT FOR HIGHWAY VEHICLES

[76] Inventor: William A. Blackwood, 2966 Boeing Rd., Shingle Springs, Calif. 95682

[21] Appl. No.: 822,193

[22] Filed: Aug. 5, 1977

[51] Int. Cl.[2] ..... B66F 9/20

[52] U.S. Cl. ..... 414/628; 414/634

[58] Field of Search ..... 214/660, 670, 671, 672, 214/673, 674, 620, 621, 75 T

[56] References Cited

U.S. PATENT DOCUMENTS

| | | | |
|---|---|---|---|
| 1,952,730 | 3/1934 | Remde | 214/671 |
| 2,372,870 | 4/1945 | Willrodt | 214/671 |
| 2,754,020 | 7/1956 | Dunn et al. | 214/670 |
| 3,307,656 | 3/1967 | Susag | 214/674 |
| 3,472,408 | 10/1969 | Hendricks et al. | 214/670 |
| 3,672,525 | 6/1972 | Schaeldler | 214/731 |
| 3,782,571 | 1/1974 | Murphy | 214/674 |

FOREIGN PATENT DOCUMENTS

| | | | |
|---|---|---|---|
| 6403722 | 10/1964 | Netherlands | 214/671 |

*Primary Examiner*—Stephen G. Kunin

*Assistant Examiner*—Terrance L. Siemens

*Attorney, Agent, or Firm*—Schapp and Hatch

[57] ABSTRACT

A hydraulically actuated forklift removably mountable at the front end of a pickup truck and having a frame supported on castered wheels and carrying an upright mast having vertically telescoping upper and lower sections and a fork assembly vertically movable in the upper mast section. Cables attached between the fork means and lower mast section are entrained over pulleys mounted at the top of the upper mast section so as to compound vertical movement of the fork means. An upright hydraulic ram is carried at its lower end on the lower section of the mast and connects to the top portion of the upper mast section. An electrically driven hydraulic pump, electric battery, reservoir and control valves are carried in an enclosed box structure forming part of the frame. The lower end of the mast is pivoted to the frame and a hydraulic cylinder moves the mast between a vertical lift position and a rearwardly inclined transport position. The control valves are solenoid actuated and are operated by power from the electric battery through a lift switch and an attitude switch.

27 Claims, 11 Drawing Figures

FORKLIFT ATTACHMENT FOR HIGHWAY VEHICLES

BACKGROUND OF THE INVENTION

The present invention relates to a forklift attachment for highway vehicles, and more particularly to forklift attachments which may be removed from a vehicle such as a pickup truck so as not to interfere with its normal use.

The desirability of a forklift attachment which can be carried at the front end of a pickup truck is readily apparent. Prior attempts to provide such an attachment have supported the forklift equipment on the bumpers or frame of the pickup truck or other vehicle. This greatly limits the amount of cargo which can be picked up and transported on the forks. Also, the heavy loading of the front end of the vehicle distorts the steering geometry, making the pickup truck or other vehicle almost uncontrollable with a heavy load. Beefing up the springs and placing weight in the back of the vehicle are at best only partial solutions. Really heavy loads still cannot be transported because of strength limitations of the front suspension, frames and wheels of the vehicle.

SUMMARY OF THE INVENTION

The forklift attachment of the present invention overcomes the limited cargo weight and strength disadvantages of the prior art devices by supporting the forklift attachment on its own wheels. These wheels are castered to follow the path of movement of the vehicle to which the forklift is attached. Relative vertical movement is provided between the forklift attachment and the vehicle, so that the castered wheels will always be supporting the weight of the forklift attachment and cargo carried thereon. Thus, bumps, chuckholes, curbs and other irregularities in the underlying road surface causing vertical displacement act independently on the vehicle and the pickup lift so as not to impose excessive loads on the vehicle chassis or suspension.

Accommodation to road irregularities is also provided by permitting the vehicle and the forklift attachment to sway or twist relative to each other. This is accomplished by a swivel interposed in the attachment connection.

The attachment connection is reinforced against cocking movement of the forklift attachment relative to the vehicle to which it is attached. This reinforcement is provided by rollers supported laterally outward of the attachment connection on the vehicle or the forklift attachment, in position to roll against a vertically disposed transverse plate mounted on one or the other of the vehicle or forklift attachment.

It therefore is a principal object of the present invention to provide a forklift attachment for a road vehicle which is capable of lifting, supporting and transporting loads in excess of the carrying capacity of the front end of the vehicle.

Another object of the present invention is to provide a forklift attachment of the character described which supports its own weight and the weight of the cargo lifted thereby.

A further object of the invention is to provide a forklift attachment of the character set forth which is readily transportable along the highway, at highway speeds, without requiring detachment from the vehicle and without imposing its full weight on the vehicle.

A still further object of the present invention is to provide a forklift attachment as described which provides for relative vertical movement between the vehicle and the forklift attachment.

A still further object of the invention is to provide a forklift attachment of the character set forth which provides for relative twisting or lateral swaying movement of the forklift attachment relative to the vehicle.

Another object of the present invention is to provide a forklift attachment of the character set forth which precludes lateral cocking movement of the forklift attachment relative to the vehicle without adversely affecting the provision for relative vertical and twisting movement.

Yet another object of the present invention is to provide a forklift attachment which may be easily and quickly secured to and removed from the vehicle in a single, easy and simple operation.

Further objects and advantages of the present invention will become apparent from the specification, claims and drawings included in this application.

BRIEF DESCRIPTION OF THE DRAWINGS

The preferred form of the present invention is illustrated in the accompanying drawings, forming part of this specification, in which.

Figure 2:
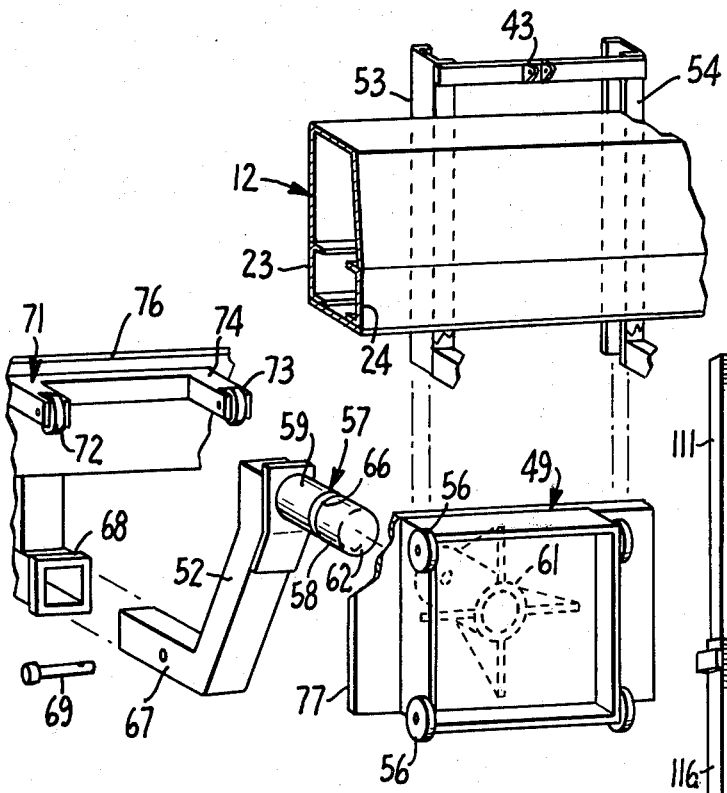
FIG. 2 is an exploded perspective view of an attachment assembly forming part of the forklift attachment of FIG. 1, portions of the view being broken away and shown in section for clarity of illustration.

While only the preferred form of the present invention has been shown here, it should be understood that various changes or modifications may be made within the scope of the claims without departing from the spirit of the invention.

DESCRIPTION OF THE PREFERRED EMBODIMENTS

Referring to the drawings in detail, it will be seen that the forklift attachment 11 of the present invention includes a frame 12 having attachment means 13 adapted for connecting the frame 12 to an end of a road vehicle, such as pickup truck 14 for movement therewith, an upright mast 16 carried on the frame 12, fork means 17 mounted for upward and downward movement on mast 16 and having forwardly projecting cargo support members 18 and 19, power means 21 for effecting the upward and downward movement of the fork means 17, and wheel means 22 mounted on the frame and formed for supporting the weight of the frame 12, fork means 17 and cargo (not shown) supported on the members 18 and 19.

Figure 1:
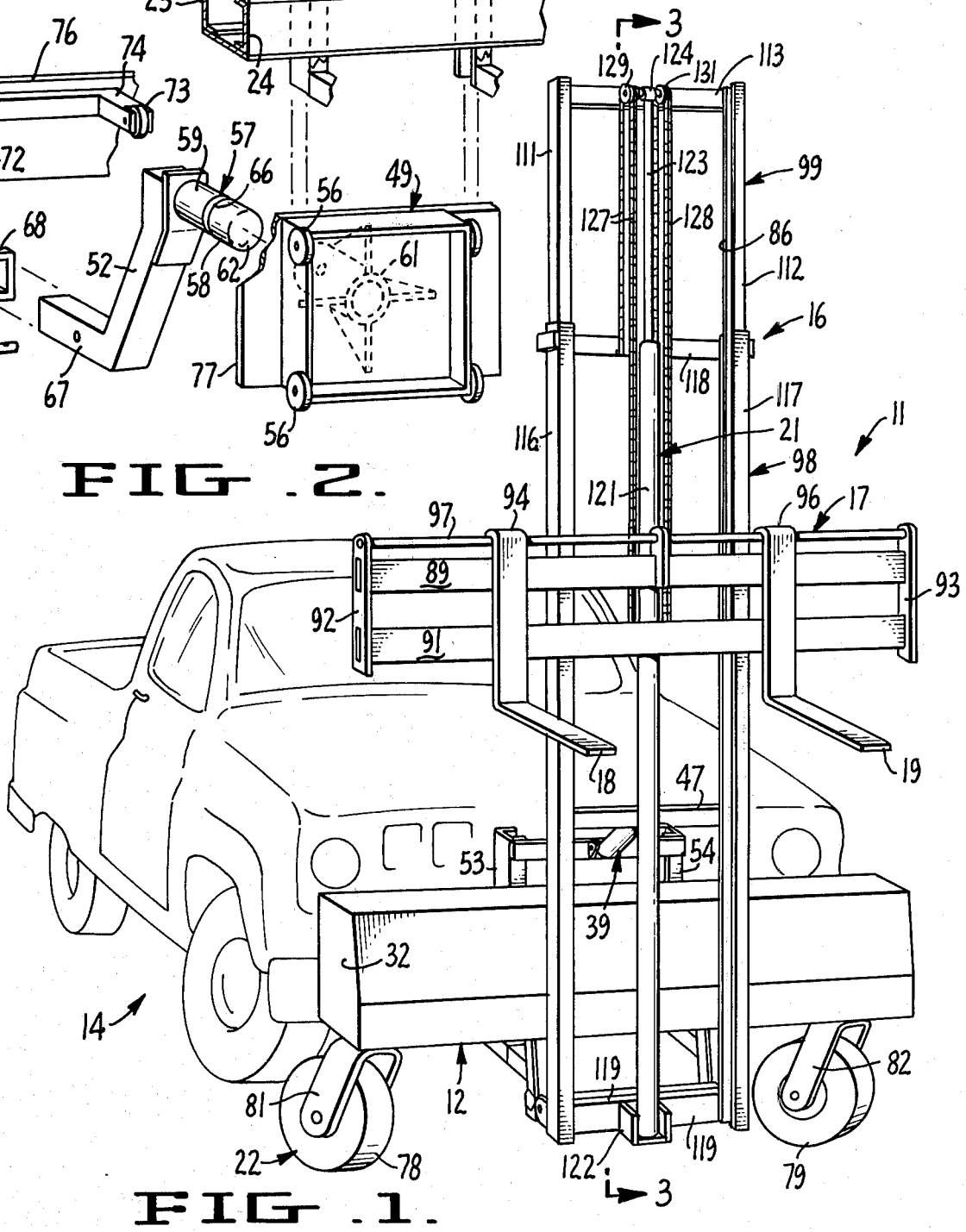
FIG. 1 is a perspective view of a forklift attachment for highway vehicles constructed in accordance with the present invention and shown in operative position attached to the front end of a pickup truck.
Figures 3, 4:
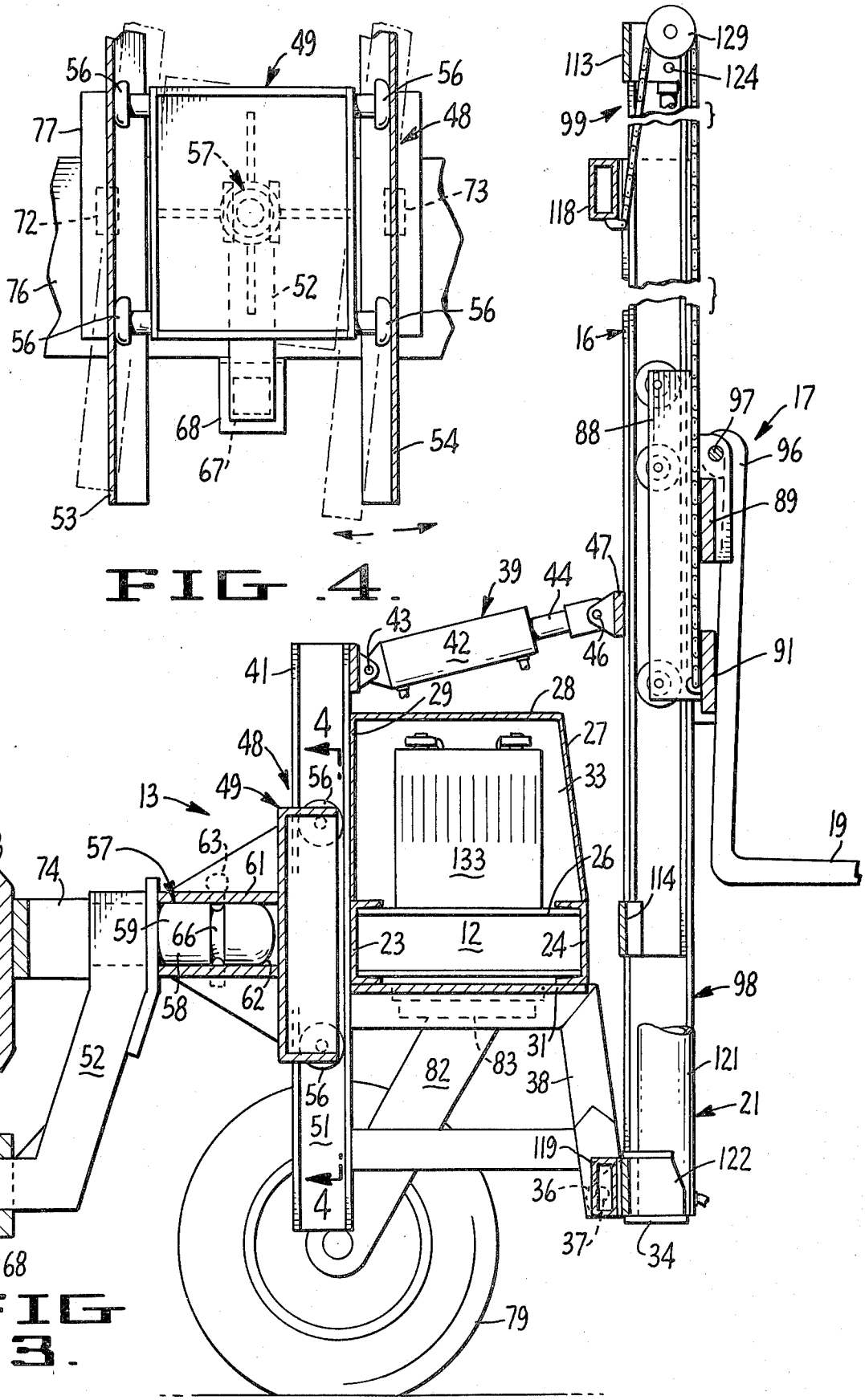
FIG. 3 is a vertical cross-sectional view on an enlarged scale taken substantially on the plane of line 3—3 of FIG. 1, with portions thereof being broken away and shown in section for clarity of illustration and to conserve space on the sheet.
FIG. 4 is a vertical, fragmentary sectional view of an attachment assembly, taken substantially on the plane of line 4—4 of FIG. 3.
Figure 5:
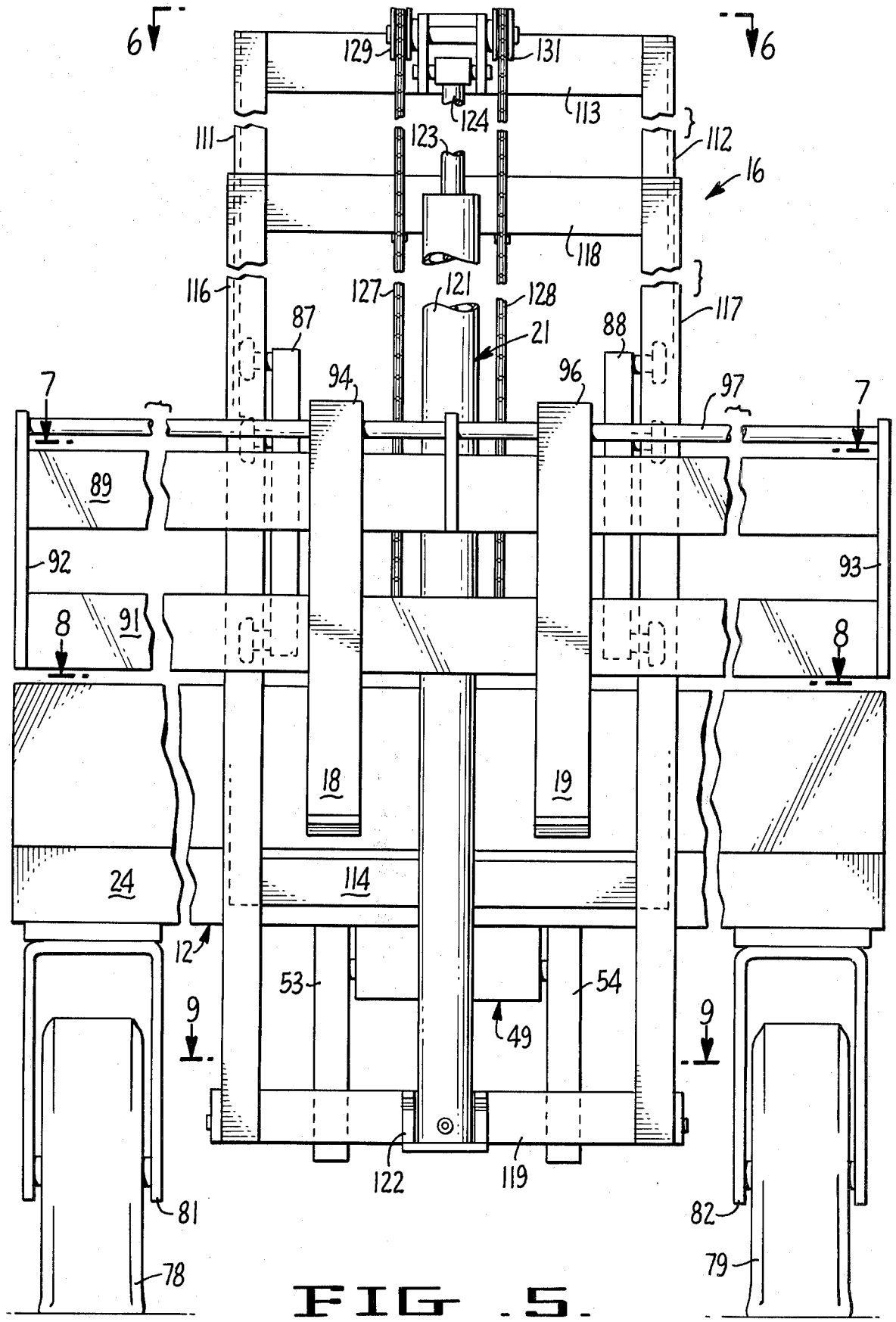
FIG. 5 is a front elevational view on an enlarged scale of the forklift attachment of FIG. 1, portions being broken away to conserve space on the sheet.
Figure 6:
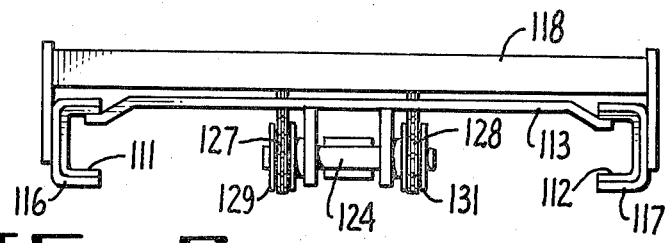
FIG. 6 is a plan cross-sectional view taken substantially on the plane of line 6—6 of FIG. 5.
Figure 7:
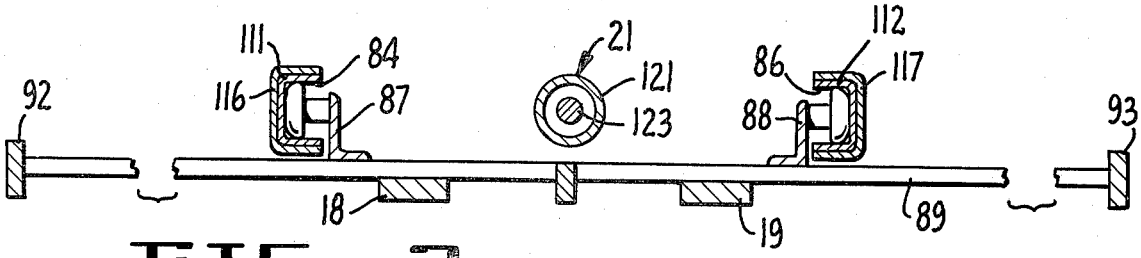
FIG. 7 is a plan cross-sectional view taken substantially on the plane of line 7—7 of FIG. 5.

As may best be seen in FIG. 1 of the drawings, the frame 12 comprises an elongated box structure extending laterally across the front end of pickup truck 14 when connected thereto by the attachment means 13 (FIG. 3). This box structure includes transversely extending channels 23 and 24 having a length approximately the width of the pickup truck 14. Cross members 26 are welded between channels 23 and 24, and the basic frame 12 is completed by front plate 27, top plate 28, rear plate 29, bottom plate 31 and two end plates 32 and 33. At least one of the plates 27, 28 and 29 is detachable to provide access to the interior of the box structure.

Lift mast 16 has its lower end 34 pivotally supported on frame 12 by means of ears 36 journaled on a laterally extending shaft 37 which is mounted in a downwardly projecting extension 38 of frame 12. Positioning means 39 connects mast 16 to an upward extension 41 of frame 12, and is formed for selective positioning of lift mast 16 in a vertical lift position or a rearwardly inclined transport position wherein the mast 16 lays back in proximity to front plate 27 of frame 12.

As here shown, the positioning means 39 includes a hydraulic attitude cylinder 42 having an end pivotally connected at 43 to frame extension 41 and a piston rod 44 having its distal end pivotally connected at 46 to a bracket 47 secured to a medial portion of the lift mast 16.

In accordance with the present invention, the attachment means 13 is formed to permit relative upward and downward movement between the frame 12 and the pickup truck 14. As may best be seen in FIGS. 3, 4, 8 and 11 of the drawings, the attachment means 13 includes guide means 48, the guide means 48 being formed for permitting relative upward and downward movement of the frame 12 and pickup truck 14 while at the same time restraining the frame 12 against lateral movement with respect to pickup 14.

As here shown, guide means 48 includes a wheeled carriage 49 movable along a vertically extending track 51, carriage 49 being mounted on a hitch device removably mountable on the front end of the pickup truck 14, and the vertically extending track 51 being mounted on the frame 12. Track 51 preferably is provided by spaced, parallel channels 53 and 54 positioned with their flanges confronting each other. Carriage 49 is a box structure having wheels 56 journaled at its four corners and formed to ride in the track channels 53 and 54.

As an important feature of the present invention, the attachment means 13 permits relative twisting movement between the frame 12 and the pickup truck 14 so as to allow relative lateral swaying movement between the forklift attachment and the pickup truck, thus accommodating irregularities in the surface of the road and avoiding breaking of the attachment means.

The described relative twisting movement is provided by a swivel connection 57 in the attachment means 13. As may best be seen in FIG. 3 of the drawings, this swivel connection 57 includes a stud member 58 secured to and extending forwardly from hitch device 52. Stud member 58 provides an elongated cylindrical surface 59 slidably engageable in a sleeve member 61 secured to wheeled carriage 49. The distal end 62 of stud member 58 is rounded to permit easy insertion into sleeve 61, and the stud member is retained therein with freedom of rotation by a pin 63 formed for removable mounting in a bore 64 provided in sleeve 61. Bore 64 is positioned so that pin 63 slidably engages a peripheral groove 66 formed in the cylindrical surface 59 of member 58. The described structure permits relative twisting movement between the forklift attachment and the pickup truck, while still restraining the forklift attachment against lateral movement relative to the pickup truck.

As here shown, the hitch device 52 includes a rearwardly extending member 67 of square cross-section slidably receivable in a square sleeve 68 attached to the frame and/or bumper supports of the pickup truck 14, a removable pin 69 being engageable through aligned bores in members 67 and 68 to hold the hitch member in place.

Also in accordance with the present invention, means is provided for preventing cocking movement of the forklift attachment 11 relative to the pickup truck 14 while permitting the above-described relative upward and downward movement, and relative twisting movement, between the forklift attachment 11 and the pickup truck 14. As used herein, the word "cocking" means lateral angular misalignment of the longitudinal center lines of the forklift attachment and the vehicle such as would tend to bend or break stud member 58.

Figure 8:
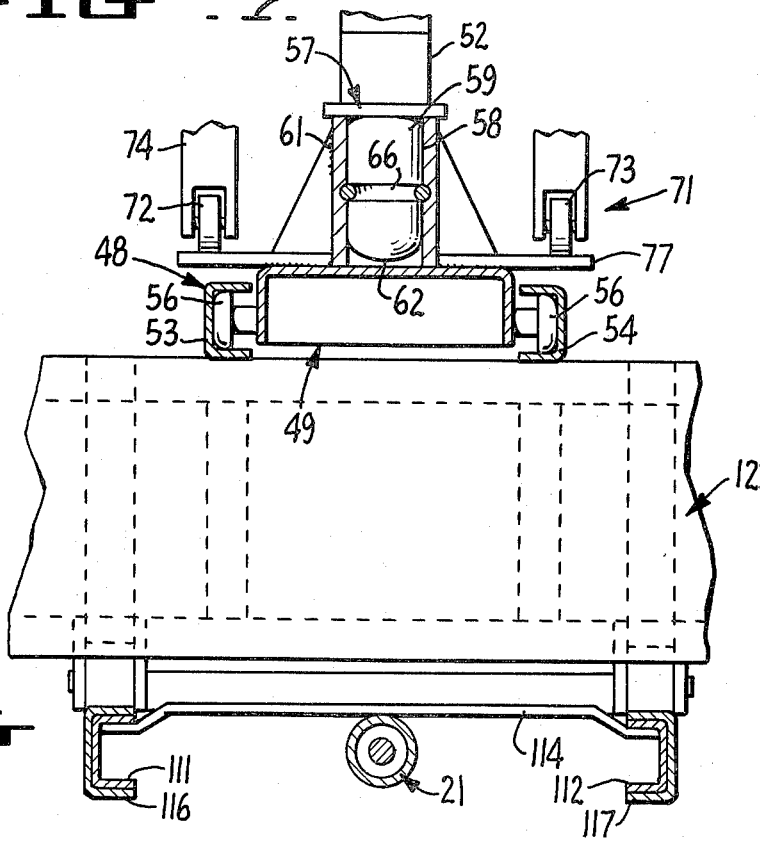
FIG. 8 is a plan cross-sectional view taken substantially on the plane of line 8—8 of FIG. 5, portions being broken away to conserve space on the sheet.
Figure 9:
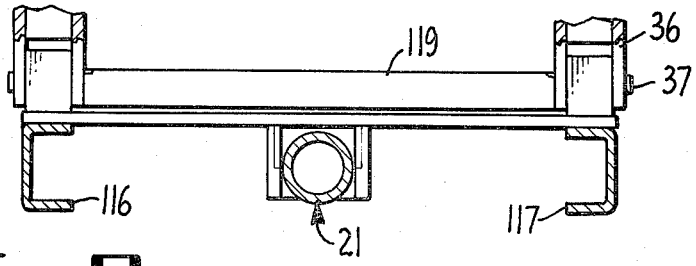
FIG. 9 is a plan cross-sectional view taken substantially on the plane of line 9—9 of FIG. 5.

The anti-cocking means preferably comprises roller and plate means 71 carried by the frame 12 and pickup truck 14. As shown in FIGS. 2, 4 and 8 of the drawings, roller and plate means 71 includes a pair of laterally spaced rollers 72 and 73 journaled in a bracket 74 secured to the bumper 76 of the pickup truck 14, with rollers 72 and 73 on opposite sides of and equidistant from the longitudinal center line of stud member 58 and sleeve 61. Rollers 72 and 73 project forwardly and are brought into rolling engagement with a vertical plate 77 attached to carriage 49, when the stud member 58 is engaged in sleeve 61 and retaining pin 63 is inserted.

Figure 11:
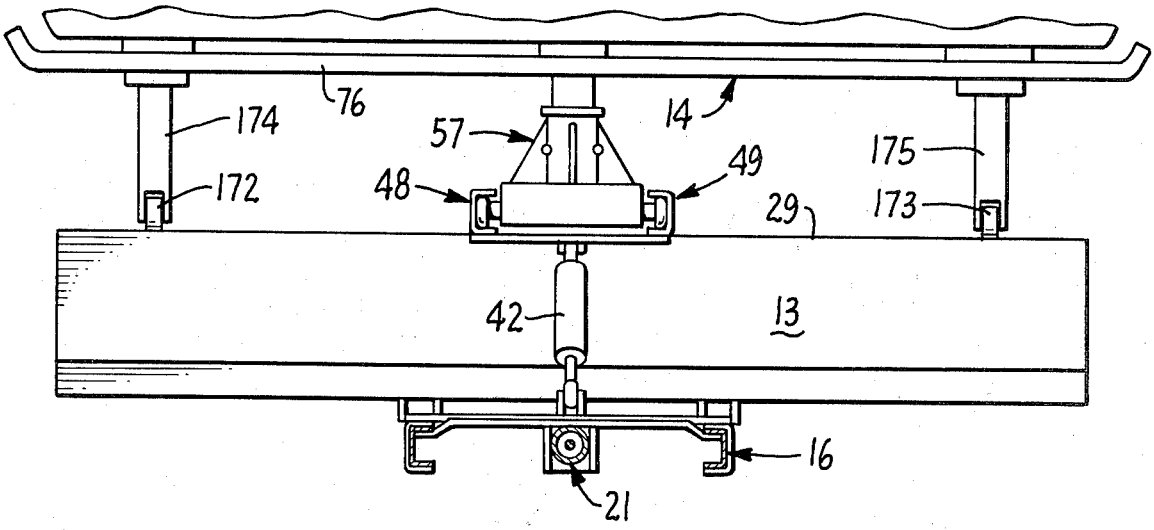
FIG. 11 is a fragmentary plan view of a modified form of the anti-cocking apparatus.

In the form of the invention illustrated in FIG. 11 of the drawings, rollers 172 and 173 are each journaled in their own brackets 174 and 175, and are positioned farther out board than rollers 72 and 73 so as to provide additional resistance to lateral cocking of the forklift attachment 11 with respect to the pickup truck 14. Brackets 174 and 175 are long enough for the rollers 172 and 173 to be pressed into rolling engagement with frame plate 29 when attachment means 13 is engaged.

It should be noted that the positioning of the rollers 72 and 73, and the rollers 172 and 173, on opposite sides of the longitudinal axis permits these rollers to perform their anti-cocking function without restricting or interfering with the described relative twisting (see FIG. 4) and/or relative upward and downward movement of forklift attachment 11 and pickup truck 14.

The wheel means 22 here includes a pair of sturdy wheels having pneumatic tires 78 and 79, the wheels being journaled in inclined forks 81 and 82 having journaled connections 83 to bottom plate 31 of frame 12. The inclination of forks 81 and 82 provide a self-castering action of the wheels so they will readily follow the path of movement as controlled by steering the pickup truck 14.

For strength, the lift mast 16 preferably includes parallel spaced channel members positioned with confronting flanges to provide guideways 84 and 86, and the fork means 17 is carried for vertical movement up and down the mast 16 on wheeled mast carriages 87 and 88 held together for joint movement by elongated horizontal members 89 and 91. As seen in FIG. 1 of the drawings, members 89 and 91 extend substantially across the width of the pickup truck 14 and have their ends attached to vertical members 92 and 93. Lift forks 18 and 19 are of substantially L-shape and have their upper ends 94 and 96 journaled for rotary and sliding movement on a horizontal rod 97 mounted in upward extensions of the members 92 and 93.

In order to reduce overall height of the forklift attachment for highway transport, etc., the lift mast 16 is of telescoping construction having a lower section 98, pivotally mounted on frame extension 38, and an upper section 99 vertically movable in the lower section. The upper section 99 is here formed of two channel members 111 and 112 providing the guideways 84 and 86, members 111 and 112 being held in parallel spaced relation by an upper cross member 113 and a lower cross member 114.

Lower mast section 98 includes a pair of parallel spaced channel members 116 and 117 sized and proportioned to slidably receive channel members 111 and 112 of the mast upper section 99. Channel members 116 and 117 are held in the desired relative position by an upper cross member 118 and a lower cross member 119.

Power means 21 for lifting the cargo engaging fork members 18 and 19 here includes a vertically extending hydraulic ram 121 mounted at its lower end in a bracket 122 secured to lower mast section cross member 119. A piston rod 123 extends from the upper end of ram 121 and is pivotally connected at 124 to the upper cross member 113 of upper mast section 99. Hydraulic fluid under pressure entering the lower end of hydraulic lift ram 121 through conduit 126 forces piston rod 123 and attached upper mast section 99 upwardly.

The upward movement of the upper section 99 of the lift mast 16 is compounded to provide twice as great upward movement of the fork means 17. This is accomplished by a pair of parallel roller chains 127 and 128 secured at their opposite ends to cross member 118 of lower mast section 98 and to member 91 of the fork means 17. Chains 127 and 128 are entrained over pulleys 129 and 131 carried by upper cross member 113 of upper mast section 99. The wheeled carriages 88 of fork means 17 ride in channels 111 and 112 of upper mast section 99. As ram piston rod 123 extends upwardly, it moves upper mast section 99 upwardly by a corresponding amount. Because of chains 127 and 128, any upward movement of mast section 99 results in twice as great upward movement of the fork means 17.

In accordance with the present invention, the power means 21 includes a hydraulic pump 131 carried on frame 12 within the enclosure defined by plates 27, 28, 29, 31, 32 and 33. Motor means 132 for driving pump 141 is also carried on frame 12 within the same enclosure. An electric battery 133 and a hydraulic fluid reservoir 134 are also mounted on frame 12 within this enclosure.

Control means 136 is provided for operatively connecting the hydraulic pump 131 to the hydraulic lift ram 121, control means 136 being formed for operating ram 121 in a manner selectively accomplishing the desired upward and downward movement of the fork means 17. Preferably, the motor means 132 and the control means 136 are electrically powered, deriving current from the electric battery 133, which may be recharged by a suitable electrical connection to the alternator or generator of the pickup truck 14 (not shown), or the battery may be replaced.

Control means 136 also is formed for selectively operating the attitude cylinder 42 to urge the lift mast 16 to its vertical lift position or its inclined transport position.

Upward and downward movement of the fork means is governed by a lift valve means 137 having a first terminal position adapted to supply fluid under pressure from the hydraulic pump 132 to the lower end of the hydraulic lift ram 121, a second terminal position adapted to vent fluid from the lower end of said hydraulic lift ram back to reservoir 134, and a neutral position closing off entry or exit of fluid into or out of the hydraulic lift ram 121. As shown diagrammatically in FIG. 10 of the drawings, valve means 137 here includes a normally closed solenoid operated valve 138 for supplying fluid under pressure to ram 121, and a normally closed solenoid operated valve 139 for venting fluid from ram 121 back to the reservoir 134.

Actuation of attitude cylinder 42, for moving mast 16 to its vertical and tilted positions, is accomplished by control means 136, which includes a solenoid operated attitude valve means 141 having first and second positions supplying fluid under pressure from the hydraulic pump 131 to the frame end 142 and mast end 143 of the attitude cylinder 42, respectively, and a neutral position closing off fluid flow into and out of the attitude cylinder.

Attitude valve means 141 here includes a two position valve 142 having a normal position supplying fluid under pressure to valve 138 and to the frame end 145 of attitude cylinder 42. In this normal position, valve 142 also vents to reservoir any fluid under pressure in conduit 144 connected to mast end 143 of attitude cylinder 42. In its energized position, valve 142 supplies fluid under pressure to conduit 144 and hence to mast end 143 of attitude cylinder 42, at the same time venting any fluid under pressure in conduit 146 communicating with frame end 145 of attitude cylinder 42. Valve 138 is normally spring biased to the position shown and functions in that position as a check valve to prevent backflow of fluid under pressure from conduit 146 to ram 121. Valve 139 is normally spring biased to the position shown, and in such position acts as a check valve to prevent flow of fluid from ram 121, a check valve 148 being interposed in conduit 149 to prevent backflow of fluid from ram 121 along that route. Thus, in their normally biased position, valves 138 and 139 block the flow of fluid to or from ram 121, thus locking up the system and maintaining piston rod 123 and attached mast section 99 at a constant elevation.

Actuation of the solenoid on valve 138 overcomes the spring bias, moving valve 138 to its other terminal position supplying fluid under pressure from conduit 139 to hydraulic ram 121. This causes the piston rod 123 and attached mast section 99 to rise until a desired elevation is reached, at which time the solenoid of valve 138 is deenergized. To lower mast section 99, the solenoid of valve 139 is energized to move the valve member to its other terminal position venting fluid from hydraulic ram 121 back to reservoir 134.

Attitude cylinder 42 is normally held in locked condition by check valve 147, which prevents flow from cylinder end 142 except when fluid under pressure is present in conduit 144, and by solenoid operated valve 151 which is formed to act as a check valve in its normally biased position to prevent fluid flow from cylinder end 143. When the solenoid of valve 142 is energized to move the valve member to its other terminal position, fluid under pressure is supplied from pump 13 through conduit 144 and valve 151 to mast end 143 of attitude cylinder 42. At the same time, fluid is vented from cylinder end 42 to reservoir 134, thus retracting piston rod 44 and moving mast 16 to its inclined travel position.

When the solenoid of valve 151 is energized, the valve moves to its terminal position, venting fluid from cylinder end 143 to reservoir 134. At the same time, the solenoid of valve 142 is deenergized and valve 142 supplies fluid under pressure from pump 131 through conduit 146 and check valve 147 to the frame end 145 of attitude cylinder 42. This urges mast 16 to its vertical lift position.

Figure 10:
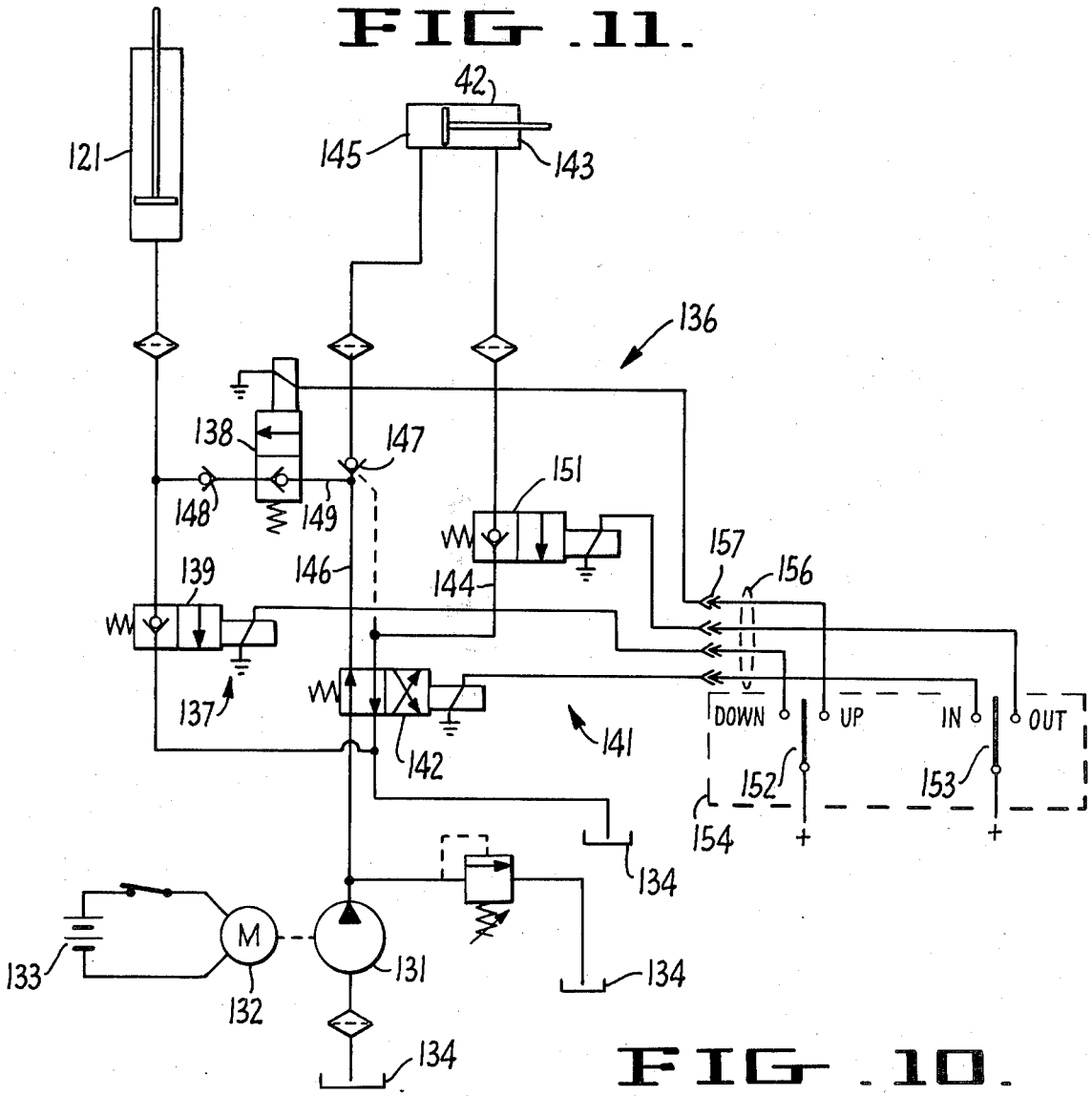
FIG. 10 is a schematic diagram illustrating the electrical and hydraulic systems of the forklift attachment of the present invention.

As shown in FIG. 10 of the drawings, vertical movement of the forklift is conveniently controlled by a three position switch 152 connected to the battery 133 and operative in a first "UP" position to energize the solenoid of valve 138, and in a second "DOWN" position to energize the solenoid of valve 139, the normally centered third position of switch 152 deenergizing both of these solenoids.

Control over the attitude of mast 16 is accomplished by a three position switch 153 operative in a first "IN" position to energize the solenoid of valve 142, and in a second "OUT" position to energize the solenoid of valve 151. The thired normally centered position of switch 153 deenergizes the solenoids of both valves 142 and 151.

Preferably, the connection of switches 152 and 153 to battery 133 is accomplished through the switch for motor 132 so that the hydraulic pump 131 operates only when the solenoid of valves 138, 139, 142 and 151 are energized.

Preferably, switches 152 and 153 are rocker switches normally biased to return to their central "OFF" position. Thus, lift ram 121 and attitude cylinder 42 will be operated to move the fork means 17 and mast 16 only when their respective switches 152 and 153 are held in one or the other of their operative positions. For convenience of operation, switches 152 and 153 can be provided in a remote control box 154 mounted at a convenient location within the cab of pickup truck 14, connection to the valve solenoids being provided by a cable 156 having a detachable connector (not shown) for occasions when the forklift attachment is removed from the pickup truck.

In operation, hitch member arm 67 is positioned in sleeve 68 and retaining pin 69 is inserted. Switches 152 and 153 are connected to the forklift attachment through cable 156 to control operation of the pump motor 132 and solenoid operated valves 138, 139, 142 and 151. Switch 153 is pressed to cause attitude cylinder 42 to extend its rod 54 and move mast 16 to its upright lift position. Switch 152 then is pressed to one of its two operative positions to raise or lower fork means 17, as may be desired.

Ordinarily, the fork means 17 will be lowered until members 18 and 19 are in close proximity to the underlying surface. The pickup truck 14 is then driven forward to engage members 18 and 19 under the cargo to be lifted. It should be noted that lateral spacing of members 18 and 19 is provided for by the general connection of their upper ends 94 and 96 on rod 97.

Switch 152 is then moved to the position actuating the solenoid on valve 138. This causes piston rod 123 of ram 121 to extend, moving mast section 99 upwardly and causing chains 127 and 128 to raise fork means 17. Thus, fork means 17 operates in a conventional manner, with up and down control being provided by switch 152 and horizontal movement and guidance being provided by pickup truck 14. The weight of forklift attachment 11 and cargo carried on forks 18 and 19 is supported by wheels 78 and 79, thus avoiding imposing excessive loads on the pickup truck. The castering action of wheels 78 and 79 permit guidance of the forklifted attachment by conventional steering of the pickup truck 14. Relative up and down and swaying or twisting movement between the forklift attachment 11 and the pickup truck 14 is provided by the described structure of the attachment means 13.

When it is desired to transport the forklift attachment 11 along the highways, fork means 17 is moved to a lowered position, members 18 and 19 are rotated 180° to lie back across the box enclosure of frame 12, and attitude cylinder 42 is energized to incline mast 16 rearwardly.

From the foregoing, it will be seen that the device of the present invention permits use of a highway vehicle such as a pickup truck to accomplish lifting and moving of loads in a manner heretofore only possible with conventional forklift vehicles. The apparatus of the present invention is easily and simply connected to and disconnected from the pickup truck by an attachment means which provides relative up and down and twisting movement between the forklift attachment and the pickup truck, making it possible to support the attachment on its own wheels so as to avoid imposing excessive loads on the pickup truck itself.

What is claimed is:

1. A forklift attachment for lifting and transporting cargo with highway vehicles, comprising a frame, attachment means adapted for connecting said frame to the front end of a road vehicle for movement therewith, a vertically telescoping mast carried upright on said frame, fork means mounted for upward and downward movement along said upright mast and having forwardly projecting cargo support members, power means for effecting said upward and downward movement of said fork means, and wheel means mounted on said frame and formed for supporting the weight of said frame and fork means and cargo supported on said members during both lifting and transport.

2. A forklift attachment as described in claim 1 and wherein said mast comprises telescoping sections, each having a pair of parallel spaced channel members positioned with confronting flanges to provide guideways and said fork means is mounted on wheeled mast carriages running in said guideways.

3. A forklift attachment as described in claim 1 and wherein said wheel means comprises a wheel journaled in an inclined fork having a caster mounting on said frame and formed for permitting said wheel to follow the path of movement of said frame relative to the underlying surface.

4. A forklift attachment as described in claim 1 and wherein said frame comprises an elongated box structure extending laterally across the front end of the vehicle when connected thereto by said attachment means and said power means comprises a hydraulic cylinder on said mast, and a motor driven hydraulic pump means mounted within said box structure.

5. A forklift attachment as described in claim 4 and wherein said wheel means comprises a pair of laterally spaced wheels having caster mountings on the underside of said elongated box structure adjacent to the ends thereof.

6. A forklift attachment as described in claim 1 and wherein said mast has a lower end pivotally supported on said frame for movement between a vertical lift position and a rearwardly inclined position, and positioning means connecting said mast to said frame means and formed for selective positioning of said mast in an extended vertical lift position and a rearwardly inclined retracted transport position.

7. A forklift attachment as described in claim 6 and wherein said positioning means comprises an hydraulic attitude cylinder connected between an upward extension of said frame and a medial portion of said mast, and an hydraulic lift cylinder operatively connected between telescoping sections of said mast.

8. A forklift attachment as described in claim 1 and wherein said attachment means is formed to permit relative twisting movement between said frame and road vehicle so as to permit relative lateral swaying movement therebetween to accommodate irregularities in the surface of the road, while at the same time preventing side to side cocking and relative vertical pitching movement between said frame and road vehicle.

9. A forklift attachment as described in claim 8 and wherein said relative twisting movement is provided by a swivel connection in said attachment means, said swivel connection comprising a tubular member and a cylindrical member rotatable therein about an axis parallel to the centerline of said road vehicle.

10. A forklift attachment as for highway vehicles, comprising a frame, attachment means adapted for connecting said frame to an end of a road vehicle for movement therewith, an upright mast carried on said frame fork means mounted for upward and downward movement along said upward mast and having forwardly projecting cargo support members, power means for effecting said upward and downward movement of said fork means, wheel means mounted on said frame and formed for supporting the weight of said frame and fork means and cargo supported on said members, said power means comprising a hydraulic pump carried on said frame, motor means for driving said hydraulic pump carried on said frame, a hydraulic lift ram mounted between said frame and said fork means and formed for effecting said upward movement, and control means operatively connecting said hydraulic pump to said hydraulic lift ram and formed for selectively accomplishing said upward and downward movement of said fork means, said control means including a lift valve means having a first terminal position adapted to supply fluid under pressure from said hydraulic pump to the lower end of said hydraulic lift ram, a second terminal position adapted to vent fluid from the lower end of said hydraulic lift ram, and a neutral position closing off entry or exit of fluid into or out of said hydraulic lift ram, said motor means and said control means being electrically powered, and a battery connected to said motor means and said control means for supplying electric current thereto, said control means further comprising a solenoid operated attitude valve means having first and second positions supplying fluid under pressure from said hydraulic pump to said attitude cylinder frame end and mast end, respectively, and a neutral position closing off fluid flow into and out of said attitude cylinder, and an attitude switch controlling said attitude valve and having cylinder extended and retracted and locked positions, said attitude switch being normally biased to said locked position.

11. A forklift attachment as described in claim 10 and wherein said control means further comprises a solenoid operated lift valve having a first position supplying fluid under pressure from said hydraulic pump to the lower end of said hydraulic lift ram, a second position venting fluid from said lower end, and a neutral position closing off fluid flow into and out of said left cylinder, and a lift switch controlling said lift valve and having a ram extending position corresponding to said first position of said lift valve, a ram retracting position corresponding to said second position of said lift valve, and a locked position corresponding to said neutral position of said lift valve, said lift switch being normally biased to said locked position.

12. A forklift attachment for highway vehicles, comprising a frame attachment means for connecting said frame to an end of a road vehicle for movement therewith, an upright mast carried on said frame, fork means mounted for upward and downward movement along said upright mast and having forwardly projecting cargo support members, power means for effecting said upward and downward movement of said fork means, wheel means mounted on said frame and formed for supporting the weight of said frame and fork means and cargo supported on said members, and guide means incorporated in said attachment means and formed for permitting relative upward and downward movement between said frame and road vehicle while restraining said frame against lateral movement with respect to the road vehicle.

13. A forklift attachment as described in claim 12 and wherein said guide means comprises a wheeled carriage movable along a vertically extending track.

14. A forklift attachment as described in claim 13 and wherein said wheeled carriage is supported on a hitch device mountable on said end of the road vehicle, and said vertically extending track is mounted on said frame.

15. A forklift attachment as described in claim 1 and wherein said power means comprises a hydraulic pump carried on said frame, motor means for driving said hydraulic pump carried on said frame, a hydraulic lift ram mounted between said frame and said fork means and formed to extend said telescoping mast for effecting said upward movement, and control means operatively connecting said hydraulic pump to said hydraulic lift ram and formed for selectively accomplishing said upward and downward movement of said fork means, so as to provide a self-contained forklift unit completely detachable from said road vehicle when not in use therewith.

16. A forklift attachment as described in claim 15 and wherein said mast has a lower telescoping section with its lower end pivotally supported on said frame, a hydraulic attitude cylinder is connected between an upward extension of said frame and the upper portion of said lower section of said mast for selectively positioning said mast in a vertical lift position and a rearwardly inclined transport position, and said control means also operatively connects said hydraulic pump to said hydraulic attitude cylinder for selectively operating the latter to urge said mast to said vertical lift and inclined transport positions.

17. A forklift attachment as described in claim 15 and wherein said control means includes a lift valve means having a first terminal position adapted to supply fluid under pressure from said hydraulic pump to the lower end of said hydraulic lift ram, a second terminal position adapted to vent fluid from the lower end of said hydraulic lift ram, and a neutral position closing off entry or exit of fluid into or out of said hydraulic lift ram, for travel along the highway.

18. A forklift attachment as described in claim 15 and wherein said motor means and said control means are electrically powered, and a battery carried by said frame is formed for supplying electric current to said motor means and said control means.

19. A forklift attachment as described in claim 18 and wherein said frame comprises an elongated box structure extending laterally across the end of the vehicle when connected thereto by said attachment means, and said motor means and said control means and said battery are mounted substantially within said box structure.

20. A forklift attachment as described in claim 1 and wherein said attachment means is formed to permit relative upward and downward movement between said frame and road vehicle.

21. A forklift attachment as described in claim 20 and wherein anti-cocking means operatively engageable with said frame and road vehicle is formed for restraining cocking movement of said frame relative to the road vehicle while permitting said relative upward and downward movement.

22. A forklift attachment as described in claim 21 and wherein said anti-cocking means comprises roller and plate means carried by said frame and road vehicle, and formed to permit relative vertical rolling movement while restraining side to side cocking relative movement between said frame and road vehicle.

23. A forklift attachment as described in claim 22 and wherein said roller and plate means comprises a pair of laterally spaced rollers adapted for mounting at said front of the vehicle on opposite sides of said attachment means for rotation of said rollers around generally horizontal axes perpendicular to the centerline of said road vehicle, and a vertical plate mounted on said frame in position to be rollingly engageable by said rollers.

24. A forklift attachment for highway vehicles, comprising a frame, attachment means for connecting said frame to an end of a road vehicle for movement therewith, an upright mast carried on said frame, fork means mounted for upward and downward movement along said upright mast and having forwardly projecting cargo support members, power means for effecting said upward and downward movement of said fork means, wheel means mounted on said frame and formed for supporting the weight of said frame and fork means and cargo supported on said members, a swivel connection in said attachment means formed to permit relative twisting movement between said frame and road vehicle so as to permit relative lateral swaying movement therebetween to accommodate irregularities in the surface of the road, and guide means incorporated in said attachment means and formed for permitting relative upward and downward movement between said frame and road vehicle while restraining said frame against lateral movement with respect to the road vehicle.

25. A forklift attachment as described in claim 24 and wherein said guide means comprises a wheeled carriage movable along a vertically extending track.

26. A forklift attachment as described in claim 25 and wherein said wheeled carriage is supported on a hitch device mountable on said end of the road vehicle, and said vertically extending track is mounted on said frame.

27. A forklift attachment as described in claim 26 and wherein said swivel connection is interposed between said hitch device and said wheeled carriage.

* * * * *